US008985977B2

(12) United States Patent
Hohl et al.

(10) Patent No.: US 8,985,977 B2
(45) Date of Patent: Mar. 24, 2015

(54) ASYMMETRIC LOBES FOR MOTORS AND PUMPS

(75) Inventors: Carsten Hohl, Hannover (DE); Helmut G. Benning, Hannover (DE)

(73) Assignee: Baker Hughes Incorporated, Houston, TX (US)

( * ) Notice: Subject to any disclaimer, the term of this patent is extended or adjusted under 35 U.S.C. 154(b) by 229 days.

(21) Appl. No.: 13/605,476

(22) Filed: Sep. 6, 2012

(65) Prior Publication Data

US 2014/0064997 A1 Mar. 6, 2014

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |
| ***F04C 2/107*** | (2006.01) |
| ***F04C 15/00*** | (2006.01) |
| ***F04C 13/00*** | (2006.01) |

(52) U.S. Cl.

CPC ..... *F04C 2/1073* (2013.01); *F04C 15/00* (2013.01); *F04C 2/1071* (2013.01); *F04C 2/1075* (2013.01); *F04C 13/008* (2013.01); *F04C 2230/91* (2013.01); *F05C 2203/08* (2013.01); *F05C 2225/00* (2013.01); *F05C 2251/02* (2013.01); *F05C 2251/10* (2013.01)

USPC ..... 418/48; 418/1; 418/152; 418/153; 418/178

(58) Field of Classification Search

USPC ..... 418/48, 152–153, 178, 179, 1

See application file for complete search history.

(56) References Cited

U.S. PATENT DOCUMENTS

| | | | | |
|---|---|---|---|---|
| 2,389,728 | A * | 11/1945 | Hill | 418/166 |
| 3,840,080 | A | 10/1974 | Berryman | |
| 5,171,138 | A * | 12/1992 | Forrest | 418/48 |
| 5,498,142 | A * | 3/1996 | Mills | 418/48 |
| 5,549,464 | A | 8/1996 | Varadan | |
| 5,833,444 | A | 11/1998 | Harris et al. | |
| 6,102,681 | A | 8/2000 | Turner | |
| 6,120,267 | A | 9/2000 | Cunningham | |
| 6,543,132 | B1 | 4/2003 | Krueger et al. | |
| 6,604,921 | B1 | 8/2003 | Plop et al. | |
| 6,944,935 | B2 | 9/2005 | Hache | |
| 7,083,401 | B2 * | 8/2006 | Hooper | 418/48 |
| 7,828,533 | B2 | 11/2010 | Podmore | |

* cited by examiner

*Primary Examiner* — Theresa Trieu

(74) *Attorney, Agent, or Firm* — Mossman, Kumar & Tyler PC

(57) ABSTRACT

An apparatus for use in a wellbore may include a stator having a bore and a rotor disposed in the bore. Either or both of the rotor and the stator may include a layer that has an asymmetrical material property profile along at least a portion of a circumference of that layer.

20 Claims, 3 Drawing Sheets

ASYMMETRIC LOBES FOR MOTORS AND PUMPS

BACKGROUND OF THE DISCLOSURE

1. Field of the Disclosure

This disclosure relates generally to moineau motors and pumps used for drilling wellbores.

2. Description of the Related Art

To obtain hydrocarbons such as oil and gas, boreholes or wellbores are drilled by rotating a drill bit attached to a drill string end. A substantial proportion of the current drilling activity involves directional drilling, i.e., drilling deviated and horizontal boreholes, to increase the hydrocarbon production and/or to withdraw additional hydrocarbons from the earth's formations. Modern directional drilling systems generally employ a drill string having a drill bit at the bottom that is rotated by a motor (commonly referred to in the oilfield as the "mud motor" or the "drilling motor").

Positive displacement motors are commonly used as mud motors. A typical mud motor includes a power section which contains a stator and a rotor disposed in the stator. A stator typically includes a housing that is lined inside with a helically contoured or lobed elastomeric material. The rotor is usually made from a suitable metal, such as steel, and has an outer lobed surface. Pressurized drilling fluid is pumped into a progressive cavity formed between the rotor and stator lobes. The force of the pressurized fluid pumped into the cavity causes the rotor to turn in a planetary-type motion. A suitable shaft connected to the rotor via a flexible coupling compensates for eccentric movement of the rotor. The shaft is coupled to a bearing assembly having a drive shaft, which in turn rotates the drill bit attached thereto.

As noted above, both the rotor and stator are lobed. The rotor and stator lobe profiles are similar, with the rotor having one less lobe than the stator. The difference between the number of lobes on the stator and rotor results in an eccentricity between the axis of rotation of the rotor and the axis of the stator. The lobes and helix angles are designed such that the rotor and stator lobe pair seal at discrete intervals, which creates axial fluid chambers that are filled by the pressurized circulating fluid. The action of the pressurized circulating fluid causes the rotor to rotate and precess within the stator.

The present disclosure provides methods and devices for increasing the reliability, durability, and efficiency of the motors (or pumps), and other similar fluid pressure differential activated devices.

SUMMARY OF THE DISCLOSURE

In aspects, the present disclosure provides an apparatus for use in a wellbore. The apparatus may include a stator having a bore and a rotor disposed in the bore. The rotor may include a layer that has an asymmetrical material property profile along at least a portion of a circumference of the layer. In another embodiment, the apparatus may have a stator having a layer defining a bore and a rotor disposed in the bore. In this embodiment, the layer of the stator has an asymmetrical material property profile along at least a portion of a circumference of the layer.

In aspects, the present disclosure further provides an apparatus that has a stator and a rotor that cooperate to form at least one fluid chamber and at least one seal during relative rotation between the rotor and the stator. A layer forming at least a portion of the at least one fluid chamber and the at least one seal may have an asymmetrical material property profile.

Examples of certain features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, reference should be made to the following detailed description of the embodiment, taken in conjunction with the accompanying drawings, in which like elements have been given like numerals and wherein.

DESCRIPTION OF THE DISCLOSURE

The present disclosure relates to methods for wellbore devices that utilize an asymmetric material property profile to enhance operation and service life of pumps and motors. As used herein, the term "asymmetric" refers to a non-uniformity, a discontinuity, or a variance in a value of a parameter or parameters. As discussed in greater detail below, the lobes of stators and/or rotors for such devices may incorporate asymmetric material properties of the used materials to enable certain different sections or sides of one component to perform different tasks.

While the teachings of the present disclosure may be advantageously applied to various types of wellbore equipment, for simplicity, the present teachings will be described in connection with moineau devices that are commonly utilized during the drilling oilfield wellbores. Generally, a moineau motor generates rotational power in response to an applied pressure differential and a moineau pump displaces fluid in response to an applied rotational power. While certain operating characteristics and configurations may vary between a pump and a motor, the present teachings may be advantageously applied to either device. For convenience, the term moineau devices encompass motors and pumps.

Figure 1A:
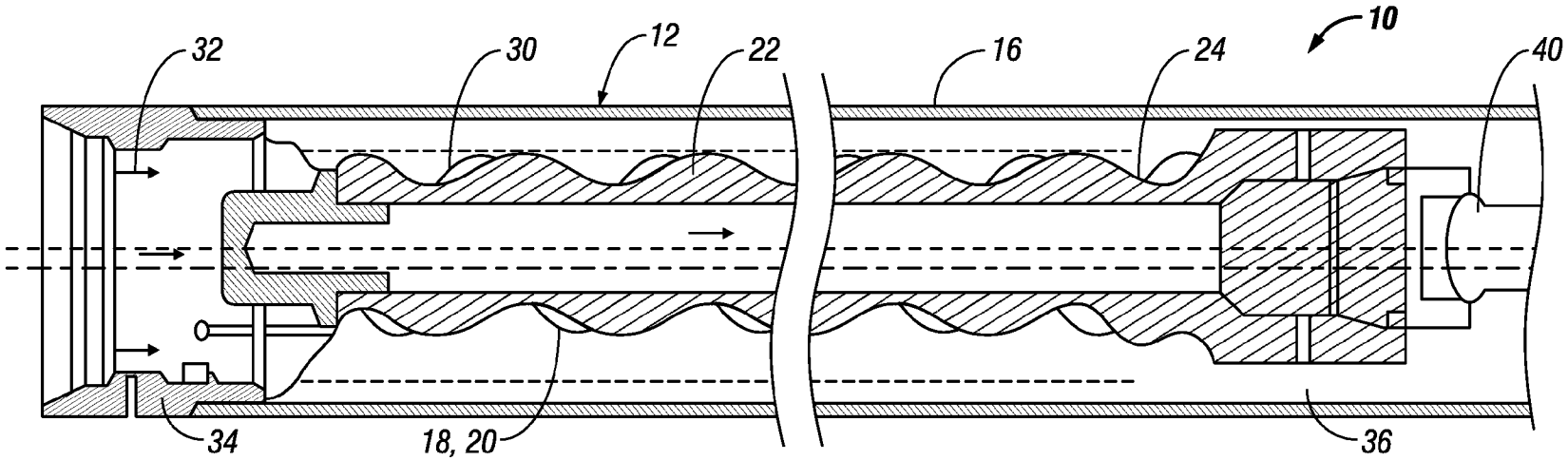
FIGS. 1A and 1B show a longitudinal cross-section of a moineau device.
Figure 1B:
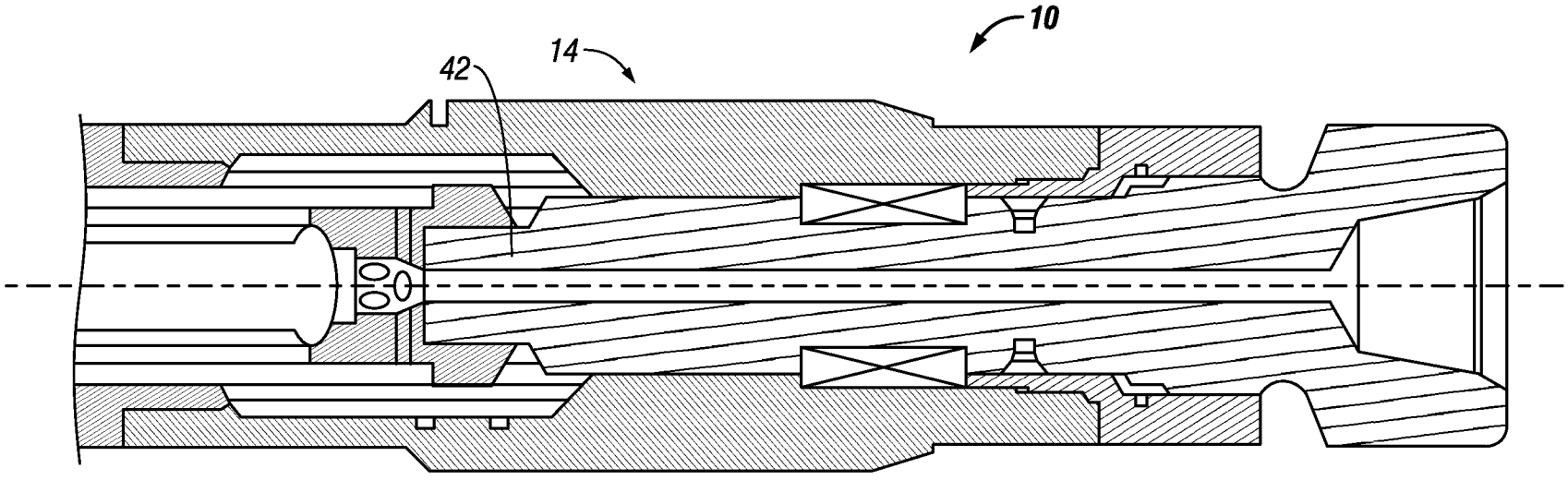

Referring initially to FIGS. 1A-1B, there is shown a cross-sectional view of a positive displacement motor 10 having a power section 12 and a bearing assembly 14. The power section 10 may contain a stator 16 that has a helically-lobed inner surface 18, which may include a lining, coating or protection member 20. The member 20 may be an elastomeric or metal lining, coating or layer configured to protect the inner surface 18 from corrosion, wear or other type of degradation.

The power section 10 may also include a rotor 22 that is configured to rotate inside the stator 16. The rotor 22 may have a helically-lobed outer surface 24 that has contours that complements the contours of the helically-lobed inner surface 18 of the stator 16. The rotor 22 and the stator 16 may have a different number of lobes, e.g., the rotor may have one less lobe than the stator 16. The contours of the stator inner surface 18 and the rotor outer surface 24 and their helical angles are such that the rotor 22 and the stator 16 seal at discrete intervals as the rotor 22 rotates eccentrically inside the stator 16. The sealing creates axial fluid chambers or closed cavities 30 that are filled by the pressurized drilling fluid 32. The fluid is displaced along the length of the motor 10 while in the cavities 30. The action of the pressurized circulating drilling mud 32 flowing from the top 34 to the bottom 36 of the power section 12 causes the rotor 22 to rotate within the stator 16. The rotor 22 may be coupled to a flexible shaft 40, which connects to a rotatable drive shaft 42 in the bearing assembly 14 that carries the drill bit (not shown).

Figure 2:
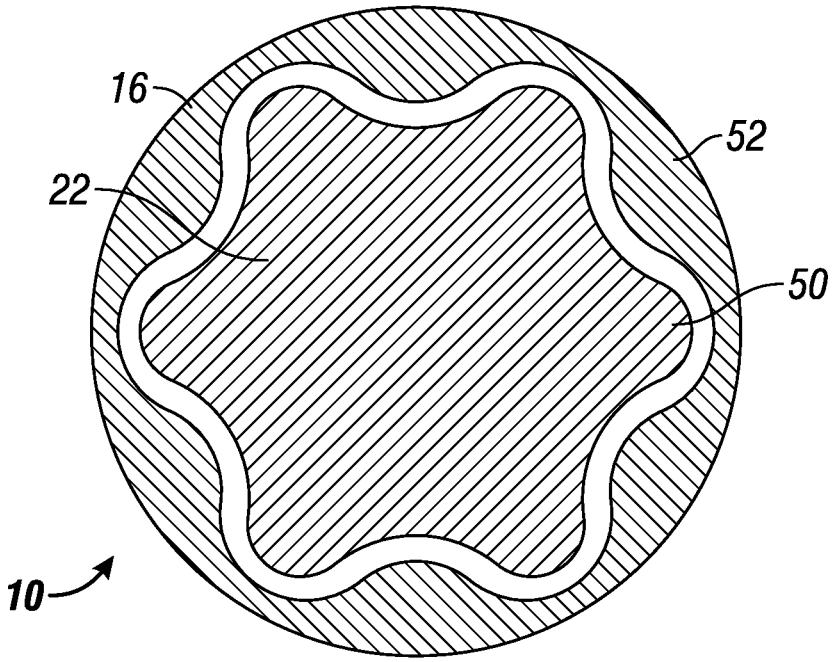
FIG. 2 illustrates a sectional end view of a stator and a rotor.
Figure 3:
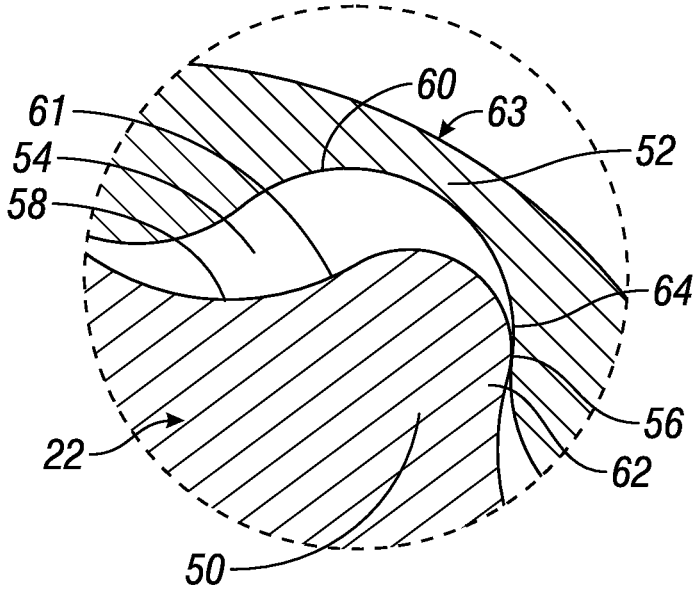
FIG. 3 illustrates a fluid cavity and a seal formed during relative rotation between the FIG. 2 stator and rotor.

Referring now to FIG. 2, there is shown a sectional view of the rotor 22 and the stator 16. As discussed above, the helical structures and lobe design of the contours form closed chambers between rotor 22 and stator 16 that make the device 10 work like a "rotating hydraulic cylinder". In operation, the lobes 50 of the rotor 22 and the lobes 52 of the stator 16 simultaneously create a closed chamber and seal. These closed chambers and seals are made and unmade cyclically as the rotor 22 rotates relative to the stator 16. Referring briefly to FIG. 3, there are shown portions of the rotor lobe 50 engaging the stator lobe 52 to form a closed chamber 54 and a seal 56. Therefore, both sides of the lobes 50, 52 fulfill different tasks. "Load sides" 58, 60 of the rotor lobe 50 and stator lobe 52, respectively, form the closed chamber 54 and mainly support the rotor 22 and transfer all forces that arise from the generated torque to the stator 16. On the other hand, the "sealing sides" 62, 64 of the rotor lobe 50 and the stator lobe 52 form the seal 56 and mainly ensure the sealing capacity of the power section. For the purposes of this discussion, the load sides 58, 60 and the sealing sides 62, 64 are the opposing sides of the rotor and stator lobes 50, 52, respectively. Thus, these sides are positioned along the same radial distance but face opposing directions.

Embodiments of the present disclosure provide lobe features that are particularly suited each of these distinct functions. For example, the stator 16 has a layer 61 having a portion at a load side 58 and a portion at a sealing side 62. Also, the rotor 22 has a layer 63 having a portion at a load side 60 and a portion at a sealing side 64. The layers 61, 63 may each use one or more materials that having one or more properties specifically suited for each of these functions. The layer portion(s) at the load sides 58, 60 must support the forces generated by the pressurized drilling fluid in the closed chamber 54. Generally speaking, materials that are relatively hard or inflexible are better suited for load bearing applications. Often, such materials exhibit relatively small elastic deformation. The layer portion(s) at the sealing sides 62, 64 must form, at least temporarily, a liquid tight seal between the contact surfaces of the rotor 22 and the stator 16. Generally speaking, materials that are pliable are better suited for sealing applications. Such materials can elastically flow or deform to block fluid paths between two surfaces.

In arrangement suitable for this application, the lobes 50, 52 may each have one or more elastomeric layers. However, the modulus of elasticity of the elastomeric layers may be different in magnitude. For instance, the load sides 58, 60 may have an elastomer formulated to have a higher modulus of elasticity than the elastomer at the sealing sides 62, 64. Suitable elastomers include, but are not limited to, natural rubber, synthetic rubber, polyisoprene, butyl rubber, polybutadiene, styrene-butadiene rubber, nitrile rubber, ethylene propylene rubber, epichlorohydrin rubber, polyacrylic rubber, silicone rubber, fluorosilicone rubber, thermoplastic elastomers, hydrogenated nitrile rubber, fluoroelastomer, perfluoroelastomer and polyurethane rubber.

Generally speaking, the material property of the layer forming the outer surface 24 of the rotor lobe 50 and the inner surface 18 of the stator lobe 52 may vary along at least along a portion of the circumference of the rotor 22 and the stator 16. This circumferential change in a material property or properties will be referred to as "an asymmetrical material property profile."

The variance in material properties along the circumferential profile may be formed using different formulations within the same type of materials. For example, the amount of "cross-linking" may be varied to cause differences in a polymers' physical properties. The variance may also be formed by physically altering a material layer by using grooves or channels in areas to reduce material rigidity. Other ways to obtain asymmetry may include applying a coating or lining, treating a surface (e.g., with heat, friction, pressure, impact, etc.), or by embedding a secondary material into a material layer. For example, a relatively soft material layer may include embedded rigid plates, a filler material, beads, or rods. Thus, the asymmetrical material property profile may be formed in a variety of ways other than by chemically varying a material property.

The above discussion involved both the rotor 22 and the stator 16 having one or more lobes formed with a layer or layers with an asymmetric material property profile. Other arrangements may include a layer with asymmetric material properties on either the rotor lobe 50 or the stator lobe 52, but not both. For example, the rotor lobes 50 may have lobes 50 formed with one or more layers having asymmetric material properties, but the stator lobes 52 may have lobes 52 with generally symmetric material properties, and vice versa. In still arrangements, the asymmetric material profile may be formed by using completely different materials. For example, the load sides 58, 60 may include a rigid or hard layer formed of a ceramic, plastic, a thermoplastic material, a duroplastic material or metal and the sealing sides 62, 64 may be formed of rubber.

It should be understood that the material properties other than the modulus of elasticity may be varied. Illustrative material properties that may be asymmetric include, but are not limited to: ductility, fatigue limit, flexural modulus, flexural strength, fracture toughness, hardness, indentation, plasticity, Poisson's ratio, shear modulus, shear strain, shear strength, specific modulus, specific weight, tensile strength, yield strength, and/or young's modulus. In some instances, such properties may also be referred to as mechanical properties.

It should also be understood that the asymmetric material property profile may also be selected to factors other than force transfer or sealing effectiveness. For example, the load sides 58, 60 are subjected to fluid pressure at a solid-liquid interface. The sealing sides 62, 64 are subjected to pressure at a solid-solid interface. Thus, the asymmetric material property may relate to wear resistance or resistance to degradation due to liquid surface contact or solid surface contact. In other arrangements, the asymmetric material property profile may be constructed to address different levels of surface abrasion, corrosion, or chemical reactivity encountered by the load side and the sealing side.

From the above, it should be appreciated that what has been disclosed includes an apparatus having a rotor disposed in a bore of a stator. The stator and the rotor cooperate to form at least one fluid chamber and at least one seal at substantially the same time during relative rotation between the rotor and the stator. A layer forming at least a portion of the at least one fluid chamber and portion of the at least one seal may have an asymmetrical material property profile. In some embodiments, the layer is formed on opposing sides of a lobe associated with the rotor and the asymmetrical material property profile is across a circumference of an outer surface of the rotor that includes the lobe. In other embodiments, the layer is formed on opposing sides of a lobe associated with the stator and the asymmetrical material property profile is across a circumference of an inner surface of the stator that includes the lobe. In still other embodiments, the rotor and the stator may each include a layer on opposing sides of a lobe and that has an asymmetrical material property profile As used above, the term "layer" is used in a functional sense to refer to a portion or section of the lobe that is specifically shaped, constructed, and dimensioned to perform the tasks of forming the closed chambers or the seals. A "layer" may exist as a homogeneous body (e.g., a separate coating or lining). The layer may also be a substrate and a lining/coating or a material having embedded secondary materials (e.g., fillers). A layer may also be composed of two or more materials vary along the circumference. That is, the layer may be composed of two or more radially or circumferentially separated layers. Furthermore, the term "material property" refers to the behavior or response of the "layer" as a whole. If the layer is formed of one homogeneous material, then the "material property" is that of the one material. However, if the layer is formed of two or more materials, then the "material" property is the property of all the materials making up the layer acting collectively. In a general sense, even if the materials vary and As is known, nearly all materials will have imperfections in manufacture and assembly that may cause variances in material properties. In the discussion above, the term "asymmetric" refers to disparities in material properties that are intentional and have been specifically engineered and calibrated to control behavior of a component in response to given operating condition. Thus, the term "an asymmetrical material property profile" refers to an intentional variance in a material property along a circumferential profile of a rotor or stator as opposed to an unintentional variance.

The foregoing description is directed to a particular embodiment of the present disclosure for the purpose of illustration and explanation. It will be apparent, however, to one skilled in the art that many modifications and changes to the embodiment set forth above are possible without departing from the scope and the spirit of the disclosure. It is intended that the following claims be interpreted to embrace all such modifications and changes.

What is claimed is:

1. An apparatus for use in a wellbore, comprising:

a stator having a bore defined by an inner first layer; and a rotor disposed in the bore and having a outer second layer, the first layer and the second layer cooperating to form at least one fluid chamber and at least one seal at substantially the same time during relative rotation between the rotor and the stator, wherein a load section and a seal section are defined along a layer selected from at least one of: (i) the first layer, and (ii) the second layer, and wherein the load section has a material property that is asymmetric with a material property of the seal section.

2. The apparatus of claim 1, wherein a material forming the first layer is harder than a material forming the seal section.

3. The apparatus of claim 1, wherein the material property is at least one of: (i) hardness, (ii) ductility, (iii) compressibility, (iv) Modulus of elasticity.

4. The apparatus of claim 1 wherein the material property is at least one of: (i) a mechanical property, and (ii) a chemical property.

5. The apparatus of claim 1, wherein the first layer and the second layer include at least one of: (i) elastomeric material, (iI) a thermo-plastic material, (iii) a ceramic material, (iv) a metallic material, (v) a composite, and (vi) a duroplastic material.

6. The apparatus of claim 1, wherein the stator includes a lobe and wherein the load section is formed on one side of the lobe and the seal section is formed on the other side of the lobe.

7. The apparatus of claim 1, wherein the rotor includes a lobe and wherein the load section is formed on one side of the lobe and the seal section is formed on the other side of the lobe.

8. The apparatus of claim 1, wherein a material forming the load section is harder than a material forming the seal section.

9. The apparatus of claim 1, wherein the first layer and the second layer each have the load second and the seal section.

10. The apparatus of claim 1, wherein:

the material property is at least one of: (i) a mechanical property, and (ii) a chemical property, wherein the seal section is more pliable than the load section, and wherein the stator includes a lobe and the rotor includes a lobe, and wherein the load section and the seal section are defined on opposing sides of one of: (i) the stator lobe, and (ii) the rotor lobe.

11. The apparatus of claim 1, wherein:

the material property is at least one of: (i) a mechanical property, and (ii) a chemical property, wherein the seal section is more pliable than the load section, and wherein the stator includes a plurality of lobes and the rotor includes a plurality of lobes, and wherein the load section and the seal section are defined on opposing sides of one of: (i) each of the plurality of stator lobes, and (ii) each of the plurality of rotor lobes.

12. A method for use in a wellbore, comprising:

disposing a rotor in a bore of the stator, wherein the stator has an inner first layer and the rotor has an outer second layer, wherein a load section and a seal section are defined along a layer selected from at least one of: (i) the first layer, and (ii) the second layer, and wherein the load section has a material property that is asymmetric with a material property of the seal section; and forming at least one fluid chamber and at least one seal using the stator and the rotor during relative rotation between the rotor and the stator.

13. The method of claim 12, further comprising defining the load section on one side of a lobe and the seal section on an opposing side of the lobe, and wherein the lobe is formed on one of: (i) the rotor, and (ii) stator.

14. The method of claim 12, further comprising forming the at least one fluid chamber and the at least one seal at substantially the same time.

15. The method of claim 12, wherein the load section and the seal section are defined along at least a portion of a circumference of one of: (i) the rotor, and (ii) the stator.

16. The method of claim 12, wherein the load section is harder than the seal section.

17. The method of claim 12, wherein the material property is at least one of: (i) a mechanical property, and (ii) a chemical property.

18. An apparatus for use in a wellbore, comprising:

a stator having a lobe, a bore, and a layer disposed over the lobe, wherein the layer has a load section on one side of the lobe and a seal section on an opposing side of the lobe, wherein the load section has a material property that is asymmetric with a material property of the seal section; and a rotor disposed in the bore.

19. The apparatus of claim 18, wherein the material property is at least one of: (i) a mechanical property, and (ii) a chemical property.

20. The apparatus of claim 18, wherein a material forming the first layer is harder than a material forming the seal section, wherein the stator includes a plurality of lobes, and wherein the load section and the seal section are defined on opposing sides of each of the plurality of stator lobes.

* * * * *